US005489927A

United States Patent [19]

Harmon

[11] Patent Number: 5,489,927

[45] Date of Patent: Feb. 6, 1996

[54] WIPER FOR INK JET PRINTERS

[75] Inventor: John P. Harmon, Corvallis, Oreg.

[73] Assignee: Hewlett-Packard Company, Palo Alto, Calif.

[21] Appl. No.: 113,877

[22] Filed: Aug. 30, 1993

[51] Int. Cl.[6] ..... B41J 2/165

[52] U.S. Cl. ..... 347/33; 15/256.5

[58] Field of Search ..... 347/22, 33; 15/256.5, 15/256.51, 256.52; 101/155, 167, 425; 355/299

[56] References Cited

U.S. PATENT DOCUMENTS

| | | | |
|---|---|---|---|
| 3,959,839 | 6/1976 | Bradley | 101/169 |
| 4,311,094 | 1/1982 | Allison | 101/425 |
| 4,479,136 | 10/1984 | Lewis et al. | 347/33 |
| 4,855,764 | 8/1989 | Humbs et al. | 347/31 |
| 4,959,673 | 9/1990 | Noda | 347/33 |
| 5,027,513 | 7/1991 | Allison, Jr. | 15/256.51 |
| 5,051,758 | 9/1991 | Markham | 347/33 |
| 5,065,158 | 11/1991 | Nojima et al. . | |
| 5,081,472 | 1/1992 | Fisher | 347/33 |
| 5,103,244 | 4/1992 | Gast et al. | 347/33 |
| 5,115,250 | 5/1992 | Harmon et al. | 347/33 |
| 5,138,395 | 8/1992 | Lindblad et al. | 355/299 |
| 5,151,715 | 9/1992 | Ward et al. | 347/33 |
| 5,177,505 | 1/1993 | Sugiura et al. | 347/22 |
| 5,298,953 | 3/1994 | Lindblad et al. | 355/299 |

FOREIGN PATENT DOCUMENTS

| | | | |
|---|---|---|---|
| 0475424 | 3/1992 | European Pat. Off. . | |
| 3-215043 | 9/1991 | Japan | 347/33 |

*Primary Examiner*—Benjamin R. Fuller
*Assistant Examiner*—John E. Barlow, Jr.

[57] ABSTRACT

A thin, relatively hard wiper is provided, the wiper including a blade defined by a pair of opposed substantially planar surfaces which are spaced less than 0.008-inches apart. The surfaces run parallel to one another, with each surface terminating in a wiping edge at a first end of the blade. To provide a blade of desired thickness, the wiper is formed from a polymer having a modulus of elasticity within the range of between 100,000-psi to 5,000,000-psi. Such polymers are commonly available as sheet material, allowing for stamp-forming of the wiper, minimizing manufacturing cost.

13 Claims, 1 Drawing Sheet

WIPER FOR INK JET PRINTERS

FIELD OF THE INVENTION

The present invention relates generally to ink-jet printers, and more particularly to an improved wiper for use in such printers. The invented wiper is thinner than conventional wipers, and is formed from a relatively hard material so as to overcome the problems commonly associated with wiper wear.

BACKGROUND ART

As will be appreciated by those familiar with printer technology, a conventional ink-jet printer includes a printhead which deposits ink onto media such as paper sheets. The printhead is mounted on a bi-directionally movable carriage, such carriage being configured to reciprocate back and forth across the paper as printing occurs. The structure and operation of such printheads and carriages are well known to those skilled in the art.

In order to keep printheads in proper working condition, most ink-jet printers employ mechanism at some point along the printhead's path to periodically service the printhead during normal use. Such mechanism generally includes a wiper with a wiping edge which sweeps across the printhead to clear its printing surface of contaminants such as dried or drying ink. In the past, wipers have been molded from an elastomeric material such as ethylene polypropylene diener monomer (EPDM), a material chosen for its flexibility and conformality to the printing surface of the printhead.

Conventional wipers, it will be noted, include a chassis-mounted base and an elongate blade which extends from the base to a tip which engages the printhead's printing surface when the printhead passes thereacross. The blade is typically planar and is of a size determined by the physical characteristics of the printer in which it is employed. In known ink-jet printers, the length is approximately 0.300-inches (accommodating printhead interference) and the width is approximately 0.315-inches (ensuring that the wiper will wipe the entire printhead). The blade's thickness is determined with these parameters in mind to produce a wiper which exerts a desired force on the printhead upon interference engagement therewith. Conventional EPDM wipers have blade thickness of approximately 0.050-inches.

Although conventional wipers have proven effective when new, the just-described arrangement presents particular problems as the wipers wear. After continued use, the wiping edges become rounded due to the repeated passage of the printhead thereacross. As the edges wear, the effectiveness of the wiper declines due to the increase in the surface area which contacts the printing surface of the printer's printhead. This increased surface area results in a hydroplane effect, the wiper passing over contaminants without wiping them away.

One possible solution to this problem would be to increase the force exerted by the wiper on the printhead, this diminishing the tendency of the wiper to hydroplane. This solution, however, would lead to increased wear of both the wiper and the printhead, an unacceptable result. It would therefore be desirable to form a wiper which avoids the effects of wear, but which operates with a relatively low force on the printhead.

Another problem with conventional wipers is related to the cost of manufacture, such wipers generally being molded to within precise tolerances so as to produce a wiper of the desired size and flexure characteristics. It is an object of this invention to provide a wiper which is more readily manufactured than conventional molded wipers.

SUMMARY OF THE INVENTION

The present invention addresses the problems identified above by providing a thin, relatively hard wiper for use in an ink-jet printer of conventional design. The wiper is of generally planar blade construction, including a pair of opposed surfaces, each of which terminates in a wiping edge at a first end of the blade. The opposed surfaces run parallel to one another, and are spaced less than 0.008-inches apart. Upon bi-directional movement of the printhead across the wiper's wiping edges, the edges will wear arcuately to a radius which is approximately one half the thickness of the blade. This relatively small radius is suitable for wiping a printhead under a force which will not cause undue wear or damage to the printhead. In order to provide a blade of desired thickness, the wiper is formed from a polymer having a modulus of elasticity within the range of between 100,000-psi to 5,000,000-psi. Such polymers are commonly available in sheets, allowing for stamp-forming of the wiper, thus minimizing manufacturing costs.

DETAILED DESCRIPTION OF THE PREFERRED EMBODIMENT

Figure 1:
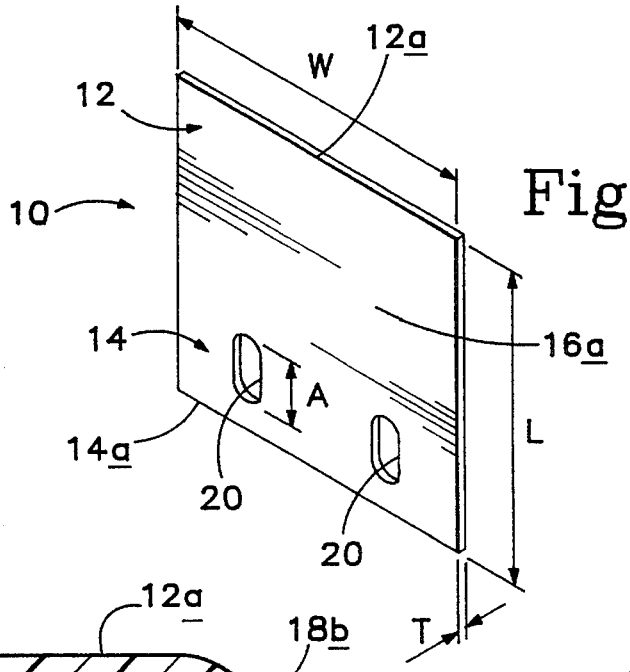
FIG. 1 is an isometric view of a wiper formed in accordance with a preferred embodiment the present invention.

Referring initially to FIG. 1, a preferred embodiment of the invented wiper is shown at 10, the wiper being configured for use in an ink-jet printer of conventional design. As indicated, the wiper is in the form of an elongate blade which includes a wiping region 12, such region terminating in a first end 12*a*. The blade also includes a securement region 14 adjacent the blade's second end 14*a*, the securement region being configured to provide for securement of the wiper to the printer's chassis 30 or on a movable sled 30*a* (FIGS. 4 and 5) as will be described below. The wiping region extends into an interference relationship with the printer's printhead 40 so as to effect wiping of the printhead's printing surface upon bi-directional passage of the printhead across the wiper (see FIGS. 4 and 5).

To accommodate use of the wiper in conventional ink-jet printers, the blade is formed in accordance with the dimensional restrictions which such printers impose. The wiper length L is chosen based on the tolerances of printer construction, and the width W is chosen based on the width of the printhead employed. Typically, the wiper is approximately 0.300-inches long, and approximately 0.315-inches wide. These dimensions are relatively constant in printers of conventional ink-jet design.

Figure 2:
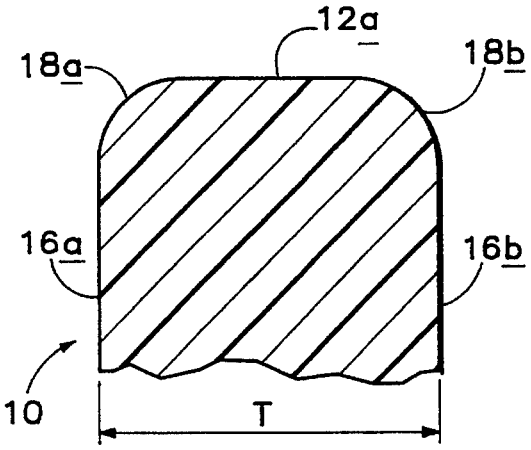
FIG.2 is a fragmentary cross-sectional side view of the wiper shown in FIG. 1, the wiper having been enlarged to illustrate partial wear of the wiper's wiping edges.
Figure 3:
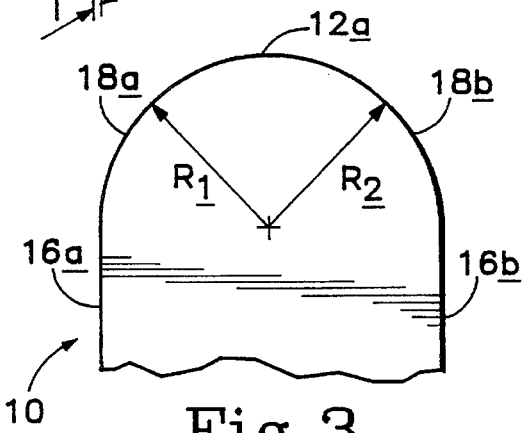
FIG. 3 is an enlarged fragmentary side view of the wiper shown in FIG. 1, the wiper's tip being worn to a semi-circular shape.

Referring to FIGS. 2 and 3, it will be noted that wiper 10 includes a pair of substantially planar surfaces 16*a*, 16*b*, such surfaces defining opposite side walls of the wiper's blade. The surfaces run substantially parallel to one another, each such surface terminating in a wiping edge 18*a*, 18*b* at the blade's first end 12*a*. These edges act on the printhead to wipe contaminants from its printing surface as the printhead passes thereacross. This is accomplished under deflection of the wiper by the printhead, such deflection producing an applied force on the printhead. This force is determined by the flexure characteristics of the wiper, and is most desirably minimal so as to avoid unnecessary printhead wear. The force, however, must be sufficient to prevent hydroplaning of the wiping edge, an effect dependant on the sharpness of the wiping edges.

Although first end 12*a* is shown with sharp edges in FIG. 1, it is to be understood that such edges will tend to wear away during normal wiper use. FIG. 2 shows the wiping edges slightly worn, and FIG. 3 shows the wiping edges worn to the maximum extent. The maximum wear of the wiping edges, it will be appreciated, is a function of the thickness T of the blade, maximum wear generally resulting in an arcuate edge with a radius of approximately T/2. Where, as in the current embodiment, a bi-directionally movable blade is used, each edge will wear to approximately the same extent, eventually leading to a wiper with a semi-circular first end (wiping tip). Such an arrangement is depicted in FIG. 3, the radius of curvature of edge 18*a* being indicated at $R_1$ and the radius of curvature of edge 18*b* being indicated at $R_2$ where $R_1=R_2=T/2$. In the preferred embodiment maximum radius $R_1=R_2=0.004$-inches.

In order to accommodate provision of a lifetime wiper (i.e., a wiper that will not be made unusable by wear of its wiping edges), the wiper is formed with a thickness T of less than 0.008-inches, a measurement corresponding to two times the maximum edge radius for effectively wiping ink. The thickness of the blade is also kept greater than 0.002-inches to avoid damage to the printhead by an unnecessarily sharp blade. In the preferred embodiment, the blade thickness is approximately 0.005-inches.

Because effectiveness of the wiper is also dependant upon the force which the blade applies to the printhead, a material is chosen which accommodates application of a sufficient force on the printhead upon deflection of the blade. Such material will have a modulus of elasticity within the range of between 100,000-psi and 5,000,000psi. This will result in a blade which applies the desired force and which has a thickness within the desired range. Most preferably, a polymer such as KAPTON (a registered trademark of E. I. du Pont de Nemours and Company) is chosen, a material formed from a polyimide and having a modulus of elasticity of approximately 370,000-psi (leading to a thickness of approximately 0.005-inches). Alternatively, a film-forming polyester such as MYLAR (a registered trademark of E. I. du Pont de Nemours and Company) or a polyethylene may be used. Such materials, it will be appreciated, are available in sheets, allowing for stamp-forming of the wipers, minimizing manufacturing costs.

Figure 4:
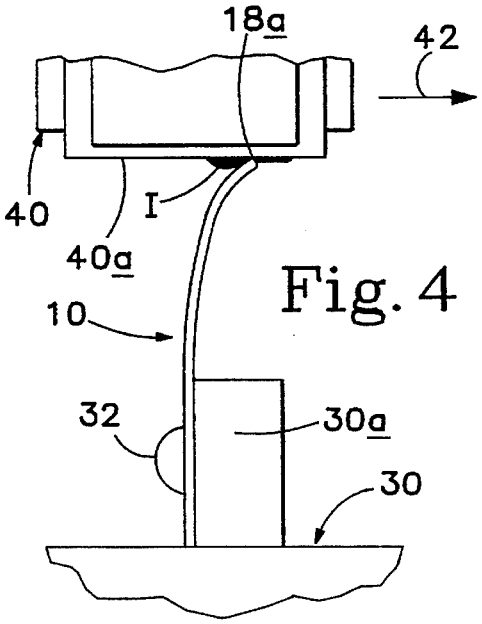
FIG. 4 is a side view of the wiper as used in an ink-jet printer, the wiper being deflected by a printhead moving thereacross in a first direction.
Figure 5:
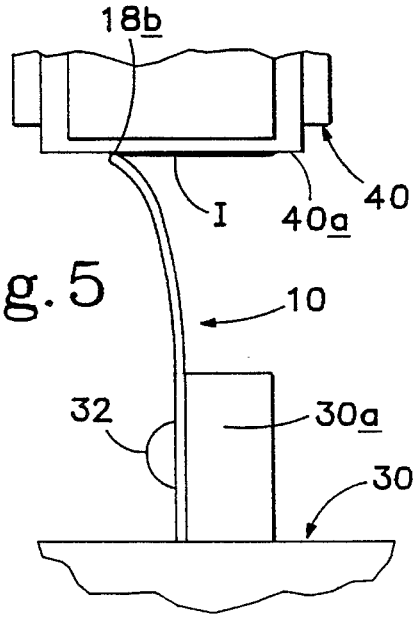
FIG. 5 is a side view of the wiper as used in an ink-jet printer, the wiper being deflected by a printhead moving thereacross in a second direction.

Referring now to FIGS. 1, 4 and 5, and focusing attention on the securement of wiper 10 to the printer, it will be noted that the wiper defines a pair of apertures 20, each aperture taking the form of an elongate slot having a length A. Such apertures accommodate securement of the wiper to the printer's chassis 30, securement preferably being made to an upstanding portion of a movable sled 30*a*. Securement is achieved using fasteners 32 which pass through apertures 20 and into sled 30*a*. Because the slot is elongate, it is possible to adjust the position of the wiper relative to the sled. It will be understood that any suitable securement means within the scope of the invention, may be provided.

As illustrated in FIG. 4, wiper 10 is placed in interference relationship with printhead 40 upon movement of the printhead over the wiper, the wiper thus being deflected and passing across the printing surface 40*a* of the printhead. As the printhead moves to the right in FIG. 4 (as indicated by arrow 42), ink I is wiped from the printhead's printing surface by wiping edge 18*a*. When the printhead moves in the opposite direction (as indicated by arrow 44 in FIG. 5) wiper 10 flexes in the opposite direction and ink I is wiped from printing surface 40*a* by wiping edge 18*b*.

Industrial Applicability

It may be seen that the invented wiper minimizes the effects of wiper wear. Even when fully worn, the wiping edges of the wiper operate to remove contaminants from the printing surface of the printhead without causing excessive wear to the printhead. The wiper is easily and inexpensively manufactured, being suited for stamp-forming from relatively thin sheets.

Although a preferred embodiment of the invented wiper is disclosed herein, it should be appreciated that the invention may be modified in detail without departing from the invention as claimed.

I claim:

1. A unitary, substantially fiat wiper for wiping a bi-directionally reciprocable printhead in an ink-jet printer, said wiper comprising:

an elongate blade formed from a polymer having a modulus of elasticity within a range of between approximately 100,000-psi and 5,000,000-psi, said blade having a pair of opposed substantially planar surfaces running substantially parallel to one another and terminating in a pair of opposed wiping edges at a first end of said blade, each of said edges defining a maximum radius of curvature of approximately 0.004-inches.

2. The wiper of claim 1, wherein said planar surfaces are approximately 0.002-inches to 0.008-inches apart.

3. The wiper of claim 19, wherein said blade terminates in a pair of opposed wiping edges at a first end of said blade, said wiping edges being positioned along a printhead travel path to wipe the printer's printhead with each printhead reciprocation.

4. The wiper of claim 1, wherein said blade includes a securement region adjacent a second end thereof.

5. The wiper of claim 4, wherein securement region defines an aperture, said aperture being suited for receipt of a fastener for securing said wiper to the printer.

6. The wiper of claim 1, wherein said blade is formed of polyimide.

7. The wiper of claim 1, wherein said blade is stamp-formed from a polyimide sheet.

8. The wiper of claim 1, wherein said blade is formed of polyester.

9. The wiper of claim 1, wherein said blade is stamp-formed from a polyester sheet.

10. The wiper of claim 1, wherein said blade is formed of polyethylene.

11. The wiper of claim 1, wherein said blade is stamp-formed from a polyethylene sheet.

12. The wiper of claim 1, wherein said blade is less than approximately 0.008-inches thick.

13. The wiper of claim 1, wherein said blade is approximately 0.005-inches thick.

* * * * *